US008317477B2

(12) United States Patent
Julius

(10) Patent No.: US 8,317,477 B2
(45) Date of Patent: Nov. 27, 2012

(54) SIMULTANEOUS TWIN PITCH ADJUSTMENT SYSTEM

(75) Inventor: Michael Julius, Boise, ID (US)

(73) Assignee: Multiquip, Inc., Carson, CA (US)

( * ) Notice: Subject to any disclaimer, the term of this patent is extended or adjusted under 35 U.S.C. 154(b) by 558 days.

(21) Appl. No.: 12/698,929

(22) Filed: Feb. 2, 2010

(65) Prior Publication Data

US 2010/0196162 A1 Aug. 5, 2010

Related U.S. Application Data

(60) Provisional application No. 61/149,254, filed on Feb. 2, 2009.

(51) Int. Cl.
*B64C 27/56* (2006.01)

(52) U.S. Cl. ..... 416/120; 416/155; 416/159; 416/168 R; 416/163

(58) Field of Classification Search ..... 416/120, 416/122, 130, 153, 155, 159, 168 R, 163
See application file for complete search history.

(56) References Cited

U.S. PATENT DOCUMENTS

| | | | | |
|---|---|---|---|---|
| 2,368,457 | A | 1/1945 | Eisenbeis | |
| 2,388,129 | A | 10/1945 | Eisenbeis | |
| 6,739,799 | B1 * | 5/2004 | Eitzen | 404/118 |
| 7,039,986 | B2 * | 5/2006 | Glenn et al. | 16/430 |
| 7,044,682 | B2 * | 5/2006 | Glenn et al. | 404/112 |
| 7,690,864 | B2 * | 4/2010 | Allen et al. | 404/112 |
| 8,132,983 | B2 * | 3/2012 | Lutz et al. | 404/112 |
| 2011/0222966 | A1 * | 9/2011 | Allen et al. | 404/103 |

OTHER PUBLICATIONS

Anonymous, Ride-On Power Trowels Hydrostatic and Mechanic Drive Models, Multiquip Inc., www.multiquip.com, Jan. 2008.
Anonymous, Operation and Parts Manual—Model HTH44T, Dec. 22, 2008, Rev. 7, Multiquip Inc., www.multiquip.com.
Anonymous, Parts and Operation Manual—HTH-Series Ride-On Power Trowel, Mar. 30, 2005, Rev. 5, Multiquip Inc., www.multiquip.com.
Anonymous, Parts Manual—JRT Ride-On Power Trowel, Nov. 4, 2002, Rev. 1, Multiquip Inc., www.multiquip.com.
Anonymous, Parts Manual—BHN Ride-On Power Trowel, Oct. 17, 2002, Rev. 1, Multiquip Inc., www.multiquip.com.
Anonymous, Parts Manual—BRT Ride-On Power Trowel, Jan. 13, 2003, Rev. 1, Multiquip Inc., www.multiquip.com.
Anonymous, Parts Manual—BTO Ride-On Power Trowel, Oct. 16, 2002, Rev. 1, Multiquip Inc., www.multiquip.com.
Anonymous, Operation and Parts Manual—Model HHN-31V, Mar. 2, 2007, Rev. 5, Multiquip Inc., www.multiquip.com.
Anonymous, Operation Manual—Model HHN-34TVDTCSL4 Model HHN-34TVDTCSL5, May 8, 2006, Rev. 1, Multiquip Inc., www.multiquip.com.

(Continued)

*Primary Examiner* — Igor Kershteyn
(74) *Attorney, Agent, or Firm* — Frank J. Dykas; Dykas & Shaver, LLP

(57) ABSTRACT

Disclosed is a simultaneous twin pitch adjustment system that includes a flexible shafting cord operatively connected to first and second couplers. The couplers are supported by posts and are operatively connected to pitch communicators. A handle is supported by each post and is configured such that manipulation of the handle translates to adjustment of the pitch of an associated rotor blade assembly. When the simultaneous twin pitch adjustment system is engaged, manipulation of one handle further translates, via the flexible shafting cord, to adjustment of the pitch of another rotor blade assembly in an amount essentially equal to the amount the associated rotor blade assembly is adjusted.

14 Claims, 14 Drawing Sheets

OTHER PUBLICATIONS

Anonymous, Parts Manual—Model HHN-34TVD, Jan. 7, 2008, Rev. 6, Multiquip Inc., www.multiquip.com.

Anonymous, Parts Manual—HRT Ride-On Power Trowel, Nov. 4, 2002, Rev. 1, Multiquip Inc., www.multiquip.com.

Anonymous, Parts Manual—HTN 27K-28K-TCSL Ride-On Power Trowel, May 12, 2006, Rev. 0, Multiquip Inc., www.multiquip.com.

Anonymous, Operation and Parts Manual—Model HTN-31VTCSL5 Model HTO-31VTCSL5, Jul. 9, 2007, Rev. 6, Multiquip Inc., www.multiquip.com.

Anonymous, Operation and Parts Manual—JTN Ride-On Trowel, Aug. 3, 2006, Rev. 5, Multiquip Inc., www.multiquip. Com.

Anonymous, Operation and Parts Manual—JTO Ride-On Trowel, Nov. 8, 2007, Rev. 5, Multiquip Inc., www.multiquip.com.

Anonymous, Operation and Parts Manual—JWN-Series Ride-On Power Trowel, Dec. 18, 2007, Rev. 8, Multiquip Inc., www.multiquip.com.

* cited by examiner

SIMULTANEOUS TWIN PITCH ADJUSTMENT SYSTEM

PRIORITY/CROSS-REFERENCE TO RELATED APPLICATIONS

This application claims the priority date of the provisional application entitled "Simultaneous Twin Pitch Adjustment System" invented by Michael Julius and filed on Feb. 2, 2009, with application Ser. No. 61/149,254, the disclosure of which is incorporated herein by reference.

FIELD OF THE INVENTION

The invention generally relates to a system for adjusting the pitch of a plurality of rotor blade assemblies and, more particularly, to a system for selectively simultaneously adjusting the pitch of a plurality of rotor blade assemblies in a power trowel.

BACKGROUND OF THE INVENTION

Ride-on power trowels generally include a plurality of rotor blade assemblies, which comprise a plurality of rotor blades. During operation, it is often desirable to adjust the pitch of the rotor blades within the rotor blade assemblies. Further, it is often desirable to adjust the pitch of rotor blades within the separate rotor blades an essentially equal amount. Accordingly, some ride-on power trowels include systems for simultaneously adjusting the pitch of rotor blades in a pair of rotor blade assemblies. However, these systems involve a number of moving mechanical parts, including miter boxes and connector extensions between one side of the adjustment system and the other. These parts provide hazards to the operator while getting into and getting out of the ride-on power trowel's operator seat. Further, the number of moving parts provides numerous opportunities for a part of the system to become dysfunctional and add to the number of areas that need periodic maintenance.

SUMMARY OF THE INVENTION

The present simultaneous twin pitch adjustment system accomplishes selective simultaneous adjustment of the pitch of rotor blades in a plurality of rotor blade assemblies while decreasing the number of parts involved, decreasing the frequency of necessary maintenance, and decreasing the hazard of getting into and out of the operator's seat of a ride-on power trowel. More specifically, the present simultaneous twin pitch adjustment system utilizes a flexible shafting cord to accomplish the connection between a plurality of pitch adjustment subassemblies. Examples of flexible shafting cords are those described by U.S. Pat. No. 2,368,457 to George G. Eisenbeis and assigned to Stow Manufacturing Co., or by U.S. Pat. No. 2,388,129 to George G. Eisenbeis and assigned to Stow Manufacturing Co, the disclosures of which are incorporated herein by reference. The connection between the plurality of pitch adjustment subassemblies can be selectively disengaged so as to allow separate pitch adjustments before reconnecting the subassemblies.

A typical power trowel, with which the simultaneous twin pitch adjustment system would be incorporated, includes a frame that supports two or more rotor blade assemblies. Taking, as an example, the power trowel having two rotor blade assemblies. The twin pitch adjustment system used therewith includes first and second mounting brackets that mount first and second posts to the frame. Atop each post is a coupler, to which is attached a handle. A pitch communicator extends from the coupler through the post to a rotor assembly connector. A flexible shafting cord extends between the two couplers. The system is configured so that when an operator manipulates one handle, the handle communicates via its respective pitch communicator to adjust the pitch of its respective rotor blade assembly and also communicates via the flexible shafting cord to adjust the pitch of the other rotor blade assembly. Accordingly, manipulation of one handle simultaneously adjusts the pitch of both rotor blade assemblies.

In instances where the operator wishes to adjust the pitch of only one rotor blade assembly, one handle is selectively disengaged from the flexible shafting cord, such that manipulation of the handle will adjust the pitch of the associated rotor blade assembly without also adjusting the pitch of the other rotor blade assembly. The handle can then be reengaged with the flexible shafting cord, such that manipulation of the handle thereafter results in simultaneous pitch adjustment of both rotor blade assemblies.

The purpose of the Summary is to enable the public, and especially the scientists, engineers, and practitioners in the art who are not familiar with patent or legal terms or phraseology to determine quickly, from a cursory inspection, the nature and essence of the technical disclosure of the application. The Summary is neither intended to define the invention of the application, which is measured by the claims, nor is it intended to be limiting as to the scope of the invention in any way.

Still other features and advantages of the claimed system will become readily apparent to those skilled in the art from the following detailed description describing preferred embodiments of the system, simply by way of illustration of the best mode contemplated by carrying out the system. As will be realized, the system is capable of modification in various obvious respects all without departing from the invention. Accordingly, the drawings and description of the preferred embodiments are to be regarded as illustrative, and not restrictive.

DESCRIPTION OF THE PREFERRED EMBODIMENTS

Figure 1:
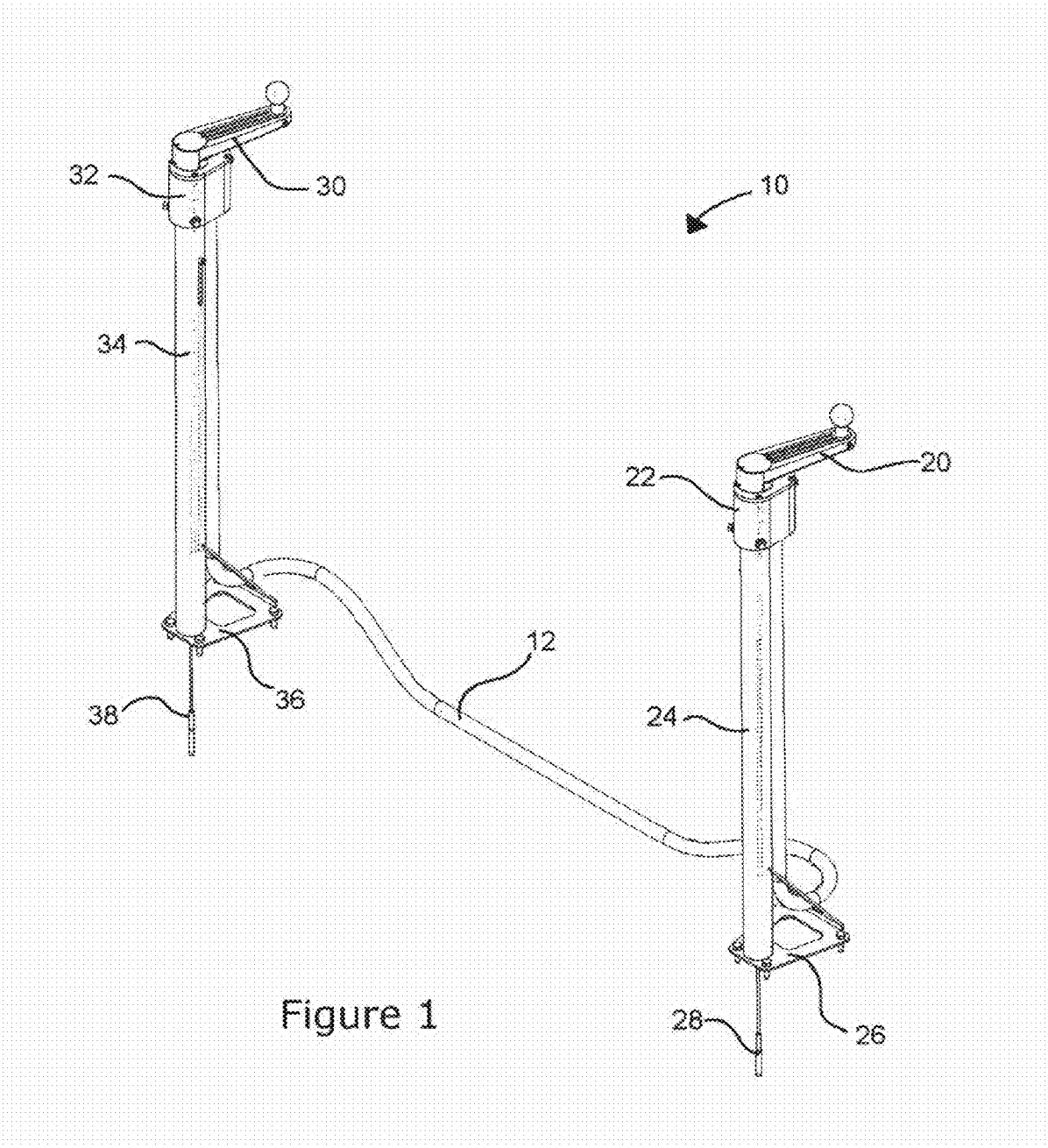
FIG. 1 is an isometric view from the top, front, and right of a simultaneous twin pitch adjustment system according to a first embodiment.

While the system is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

As shown in the figures, for purposes of illustration, depicted is a system for selectively and simultaneously adjusting the pitch of a plurality of rotor blades within separate rotor blade assemblies. The system includes few parts, thereby decreasing the potential for system failure and the frequency of maintenance. The arrangement of the parts further decreases the hazards and risks to an operator getting into and out of the trowel's operator seat.

FIG. 1 depicts the simultaneous twin pitch adjustment system 10 according to a first embodiment. The twin pitch adjustment system 10 includes a first mounting bracket 26 and a first post 24 connected to the first mounting bracket 26. A first pitch communicator 28 extends at least partially through the first post 24. Ideally, the first pitch communicator 28 extends from the top of the first post 24 down past the first mounting bracket 26 and to a point where it communicates to a first rotor blade assembly 42 (shown in FIG. 8). The first pitch communicator 28 is operatively connected to a first rotor blade included within the first rotor blade assembly 42.

A first coupler 22 is connected to the first post 24 and is supported thereby. The first coupler 22 is further connected to the first pitch communicator 28. A first handle 20 supported by the first coupler 22 is configured to be manipulated by an operator and further configured so that manipulation of the first handle 20 translates to manipulation of the first pitch communicator 28, and, thereafter, manipulation of the pitch of the first rotor blade within the first rotor blade assembly 42.

Preferably, the first mounting bracket 26 is supported by and mounted to a first rotor assembly connector 27 (FIGS. 8 and 9), via which the first pitch communicator 28 is operatively linked with pitch adjustment mechanisms configured to communicate pitch adjustment commands transmitted by the first pitch communicator 28 to ultimate adjustment of the pitch of blades within the first rotor blade assembly 42.

The simultaneous twin pitch adjustment system 10 further includes a second mounting bracket 36 and a second post 34 connected to the second mounting bracket 36. A second pitch communicator 38 extends at least partially through the second post 34. Ideally, the second pitch communicator 38 extends from the top of the second post 34 down past the second mounting bracket 36 and to a point where it communicates to a second rotor blade assembly 44 (shown in FIG. 8). The second pitch communicator 38 is operatively connected to a second rotor blade included within the second rotor blade assembly 44.

A second coupler 32 is connected to the second post 34 and is supported thereby. The second coupler 32 is further connected to the second pitch communicator 38. A second handle 30 supported by the second coupler 32 is configured to be manipulated by an operator and further configured so that manipulation of the second handle 30 translates to manipulation of the second pitch communicator 38, and, thereafter, manipulation of the pitch of the second rotor blade within the second rotor blade assembly 44.

Preferably, the second mounting bracket 36 is supported by and mounted to a second rotor assembly connector 37 (FIG. 8), via which the second pitch communicator 38 is operatively linked with pitch adjustment mechanisms configured to communicate pitch adjustment commands transmitted by the second pitch communicator 38 to ultimate adjustment of the pitch of blades within the second rotor blade assembly 44.

Figure 14:
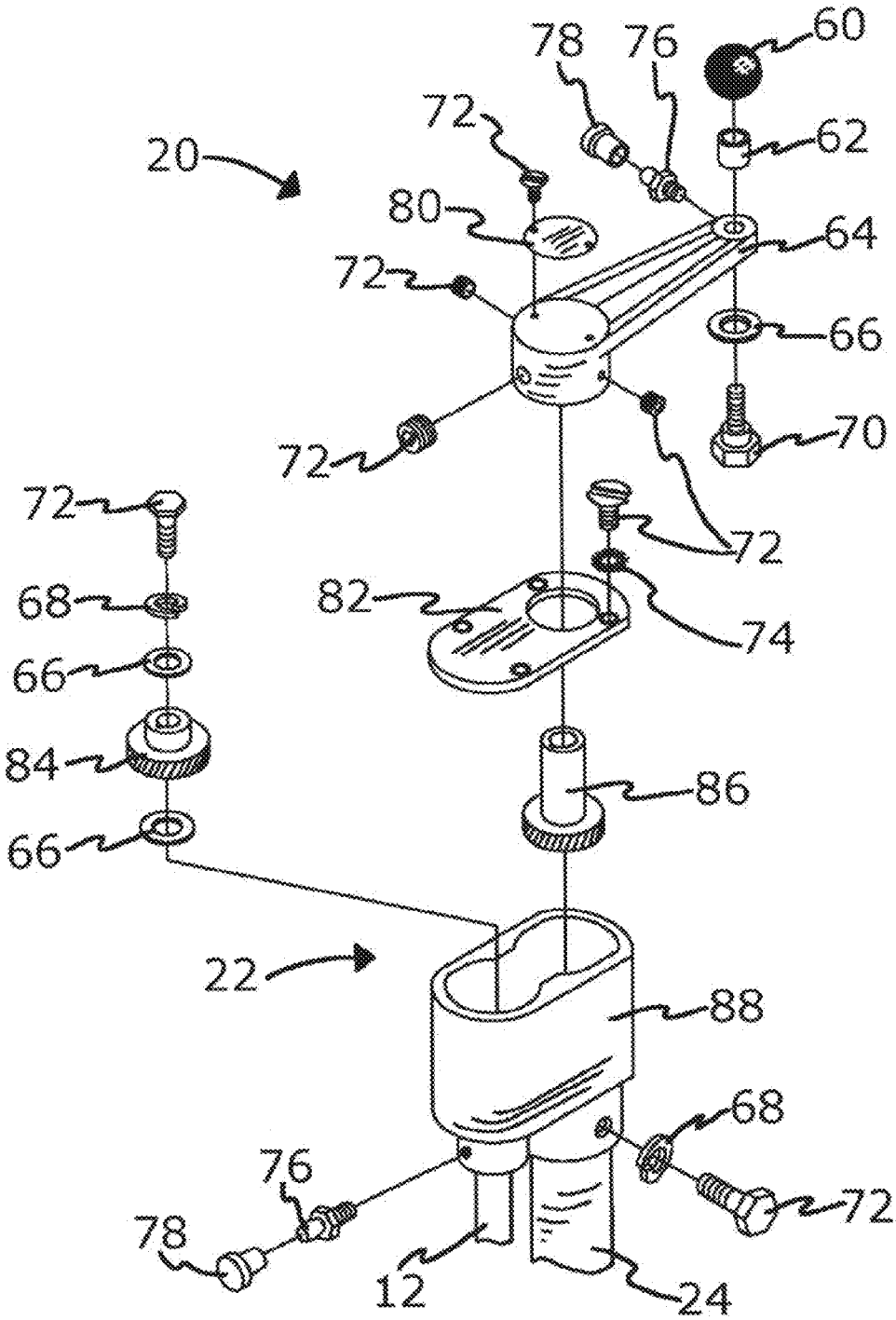
FIG. 14 is a partial, exploded view of the front, top, and right side of the first handle and first coupler parts of a simultaneous twin pitch adjustment system according to a first embodiment.

The simultaneous twin pitch adjustment system 10 further includes a flexible shafting cord 12 that has a first cord end and a second cord end. As shown in FIG. 14, the first cord end of the flexible shafting cord 12 is operatively connected to the first coupler 22. The second cord end of the flexible shafting cord 12 is operatively connected to the second coupler 32 (and would be a view identical to that shown in FIG. 14, but with association to the second handle 30, second coupler 32, and second post 34, rather than to the first handle 20, first coupler 22, and first post 24, respectively).

The flexible shafting cord 12 is further configured such that, selectively, manipulation of the first handle 20 translates through the flexible shafting cord 12 to the second handle 30 and thus while manipulation of the first handle 20 leads to adjustment of the pitch of the first rotor blade within the first rotor blade assembly 42, selectively, via the flexible shafting cord 12, manipulation of the first handle 20 further leads to adjustment of the pitch of the second rotor blade within the second rotor blade assembly 44. Accordingly, the operator may manipulate one handle so as to adjust the pitch of rotor blades within the plurality of rotor blade assemblies of the machine essentially an equal amount. Of course, it is preferred that the simultaneous twin pitch adjustment system 10 is configured such that manipulation of either the first handle 20 or the second handle 30 translates to manipulation of both the first pitch communicator 28 and the second pitch communicator 38 so as to adjust the pitch of both the first and second rotor blades within the first rotor blade assembly 42 and the second rotor blade assembly 44 essentially an equal amount.

According to the one embodiment, shown in FIG. 14, the first handle 20 includes a knob 60 that attaches to a crank lever 64 via the connection of the knob 60 to a spacer 62, flat washer 66, and shoulder bolt 70. The knob 60 is configured such that it is free to rotate relative to the crank level 64. As such, when an operator holds the knob 60 to rotate the crank lever 64, the operator's hand may stay in place on the knob 60 while the crank lever 64 turns about its axis. In some embodiments, a screw 72 also attaches a decal 80 to the crank lever 64. The crank lever 64 is attached to the cover 82 of the housing 88 of the first coupler 22 via additional screws 72 and a small washer 74. Within the housing 88 is a master gear 86 that is aligned with the first post 24. A slave gear 84 is also contained within the housing 88 and is aligned with the flexible shafting cord 12. The slave gear 84 is attached to the housing 88 via a screw 72, a lock washer 68, and a pair of flat washers 66. The flexible shafting cord 12 is affixed to the housing 88 via a fitting 76 that is covered with a cap 78. The first post 24 is affixed to the housing 88 via a screw 72 and lock washer 68. Further, the master gear 86 is operatively connected with the first pitch communicator 28 that extends through the first post 24. The slave gear 84 is operatively connected with the flexible shafting cord 12. Preferably, the same assembly is utilized within the second coupler 32, but such that the housing 88 of the second coupler 32 attaches to the second post 34 and the other end of the flexible shafting cord 12.

As shown in FIG. 14, the first handle 20 is configured such that rotation of the knob 60 around the center of the crank lever 64 translates to rotation of a master gear 86 contained within the housing 88 of the first coupler 22. The master gear 86 is further operatively connected with the first pitch communicator 28, which extends through the first post 24. Thus, manipulation of the first handle 20 results in manipulation of the first pitch communicator 28 and, therefore, adjustment of the pitch of the blades within the first rotor blade assembly 42.

Also as shown in FIG. 14, the slave gear 84, when the first handle 20 is in an engaged position, is arranged so as to be in operative connection with the master gear 86. Accordingly, rotation of the master gear 86 translates to rotation of the slave gear 84. The slave gear 84 within the first coupler 22 is in operative connection with the first end of the flexible shafting cord 12. The second end of the flexible shafting cord 12 is operatively connected with a second slave gear 84 that is operative connection with the master gear 86 within the housing 88 of the second coupler 32. Thus, when the first handle 20 and second handle 30 are both in the engaged position, such as in a lowered position, the slave gear 84 and master gear 86 of each housing 88 are in operative connection and manipulation of one handle 20 or 30 translates to rotation of the associated master gear 86, which translates to rotation of the associated slave gear 84, which translates via the flexible shafting cord 12 to rotation of the other slave gear 84, which translates to rotation of the other master gear 86, which translates through the other pitch communicator 28 or 38 to pitch adjustment of the other rotor blade assembly 42 or 44.

Each handle 20, 30 is further configured so that each can be selectively positioned in a disengaged position, such as by raising the handle away from the coupler to bring the master gear 86 out of operative communication with the slave gear 84. In the disengaged position, manipulation of the handle 20, 30 translates to manipulation of the master gear 86 and manipulation of the associated pitch communicator 28 or 38 so as to adjust the pitch of the blades of only the associated rotor blade assembly 42 or 44. Accordingly, when the first handle 20 is raised or otherwise placed in the disengaged position such that the master gear 86 within the first coupler 22 is taken out of operative connection with the slave gear 84, manipulation of the first handle 20 leads to adjustment of the pitch of the blades of the first rotor blade assembly 42, but not adjustment of the blades of the second rotor blade assembly 44. Alternatively, with the first handle 20 in the disengaged position, manipulation of the second handle 30 leads to adjustment of the pitch of the blades of the second rotor blade assembly 44, but not adjustment of the blades of the first rotor blade assembly 42. Likewise, when the second handle 30 is raised or otherwise placed in the disengaged position such that the master gear 86 within the second coupler 32 is taken out of operative connection with the slave gear 84, manipulation of the second handle 30 leads to adjustment of the pitch of the blades of the second rotor blade assembly 44, but not adjustment of the blades of the first rotor blade assembly 42. Alternatively, with the second handle 30 in the disengaged position, manipulation of the first handle 20 leads to adjustment of the pitch of the blades of the first rotor blade assembly 42, but not adjustment of the blades of the second rotor blade assembly 44. However, transitioning the handles 20, 30 back into the engaged position, such as by lowering the handle, to bring the master gear 86 back into operative connection with the slave gear 84, the simultaneous pitch adjustment is again engaged such that manipulation of one handle 20, 30 leads to adjustment of the blade pitch within both rotor blade assemblies 42, 44.

Preferably, the linkage between the first handle 20 and second handle 30 via the flexible shafting cord 12 is selectively activated by the operator, such as by positioning the first handle 20 and second handle 30 in a lowered position, wherein the handle 20 or 30 is in close proximity to the associated coupler 22 or 32, to put the handles 20, 30 in an engaged position. Accordingly, if and when the operator wants to adjust the pitch in only one of the rotor blade assemblies 42, 44, the twin-pitch adjustment connection via the flexible shafting cord 12 may be selectively disengaged, such as by placing the first handle 20 or second handle 30 in a disengaged position such as by raising either handle 20, 30 to move the handle 20, 30 farther away from the associated coupler 22 or 32. This allows the operator to adjust the desired rotor blade assembly's blade pitch by adjusting the associated handle 20, 30. Following which, when the operator desires to again provide for simultaneous twin pitch adjustment via the flexible shafting cord 12, the connection between the first handle 20 and the second handle 30 may be selectively engaged as by repositioning the first handle 20 and second handle 30 to the engaged position, such as a lowered position.

In other embodiments, however, the connection between the first handle 20 and the second handle 30 via the flexible shafting cord 12 is not selectively disengageable.

Figure 2:
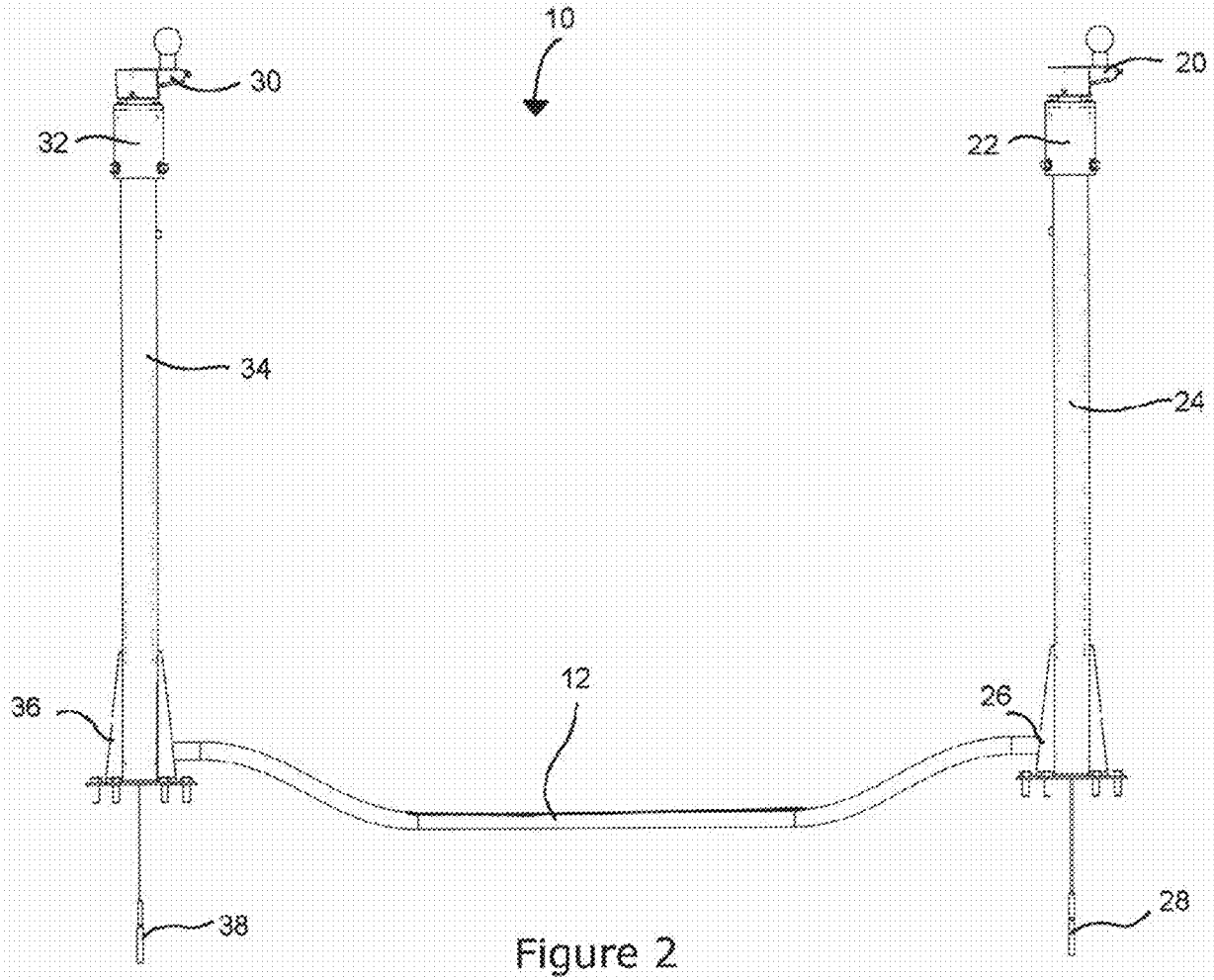
FIG. 2 is a front elevation view of a simultaneous twin pitch adjustment system according to a first embodiment.
Figure 3:
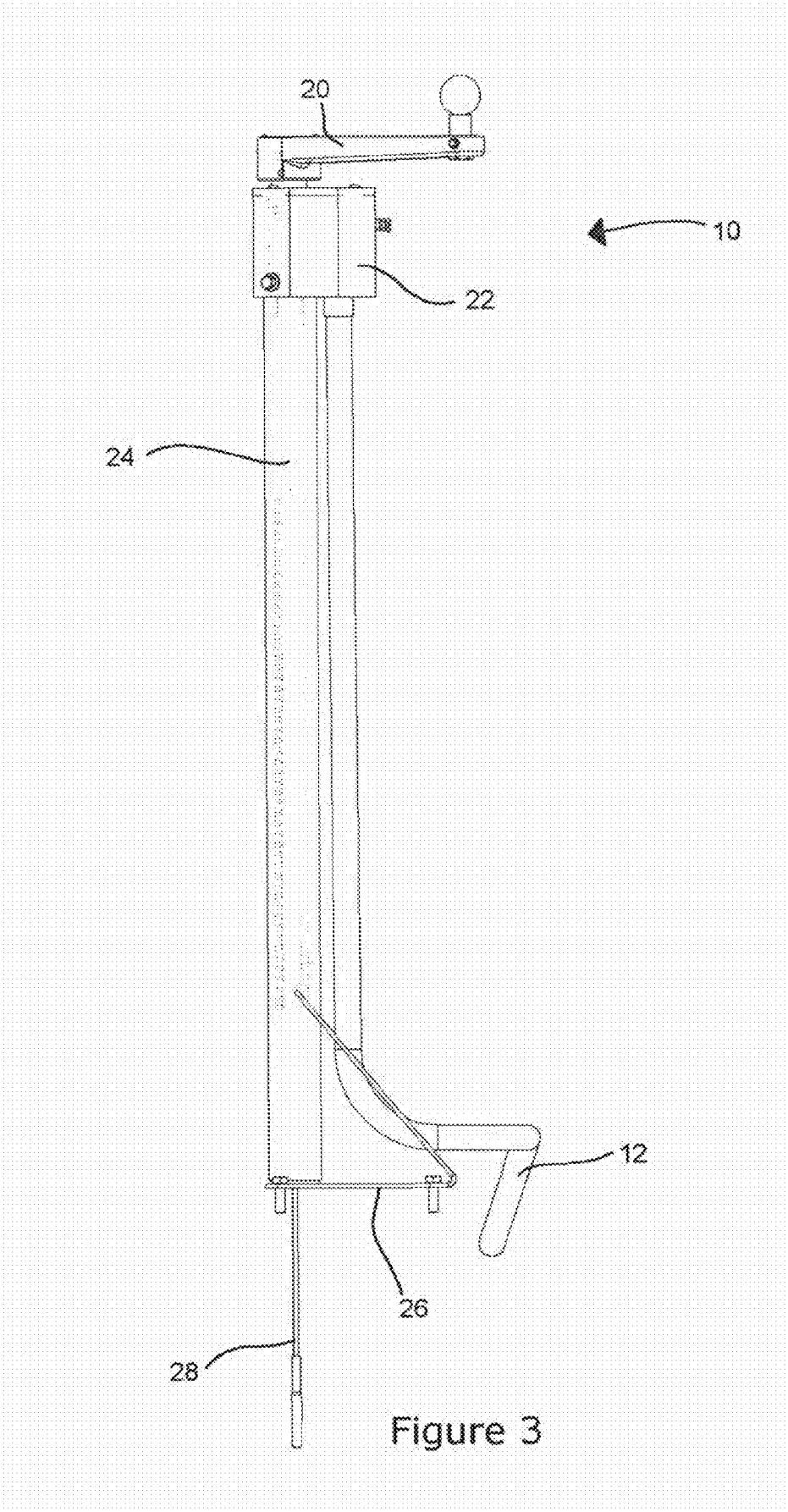
FIG. 3 is a right side elevation view of a simultaneous twin pitch adjustment system according to a first embodiment.
Figure 4:
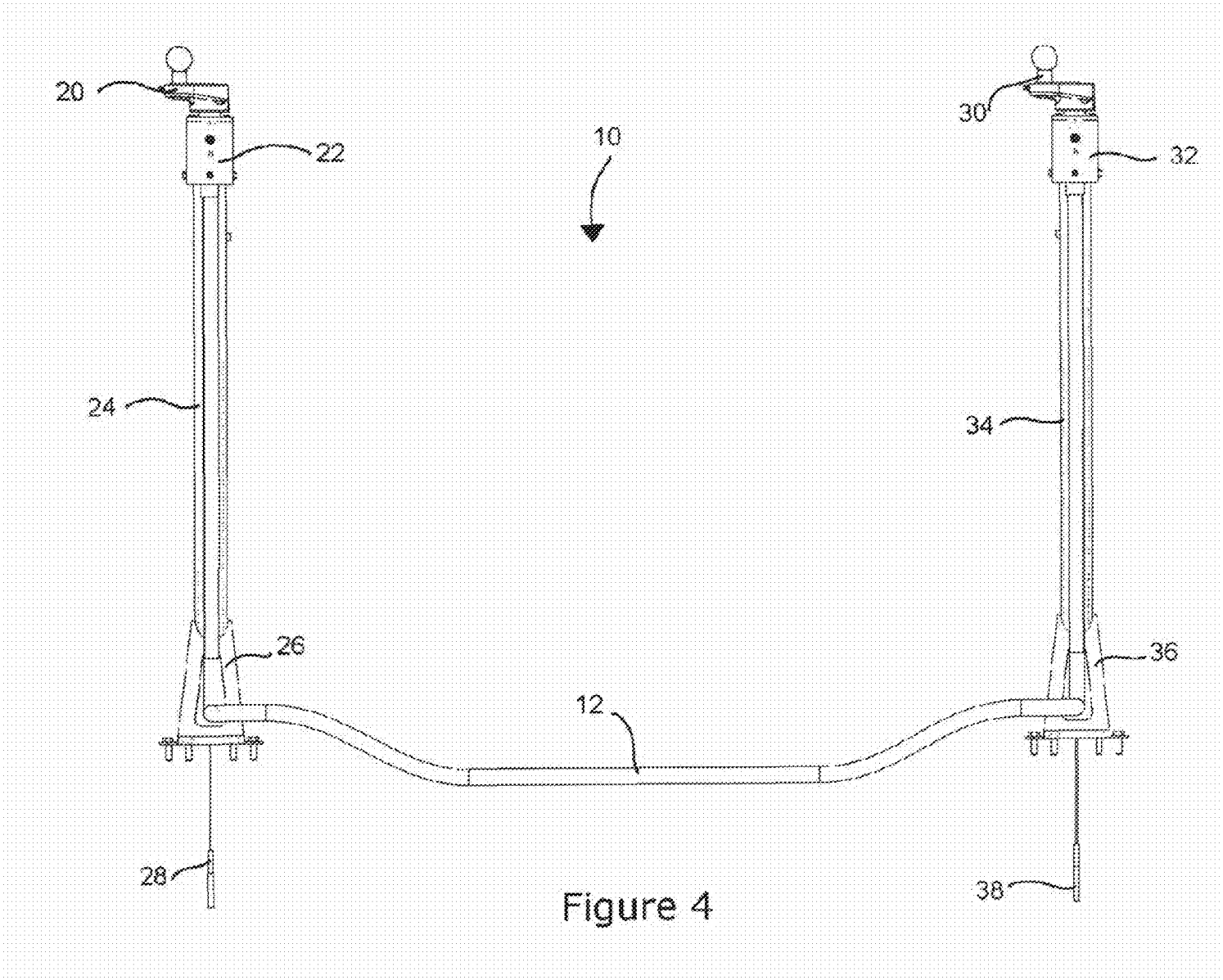
FIG. 4 is a rear elevation view of a simultaneous twin pitch adjustment system according to a first embodiment.
Figure 5:
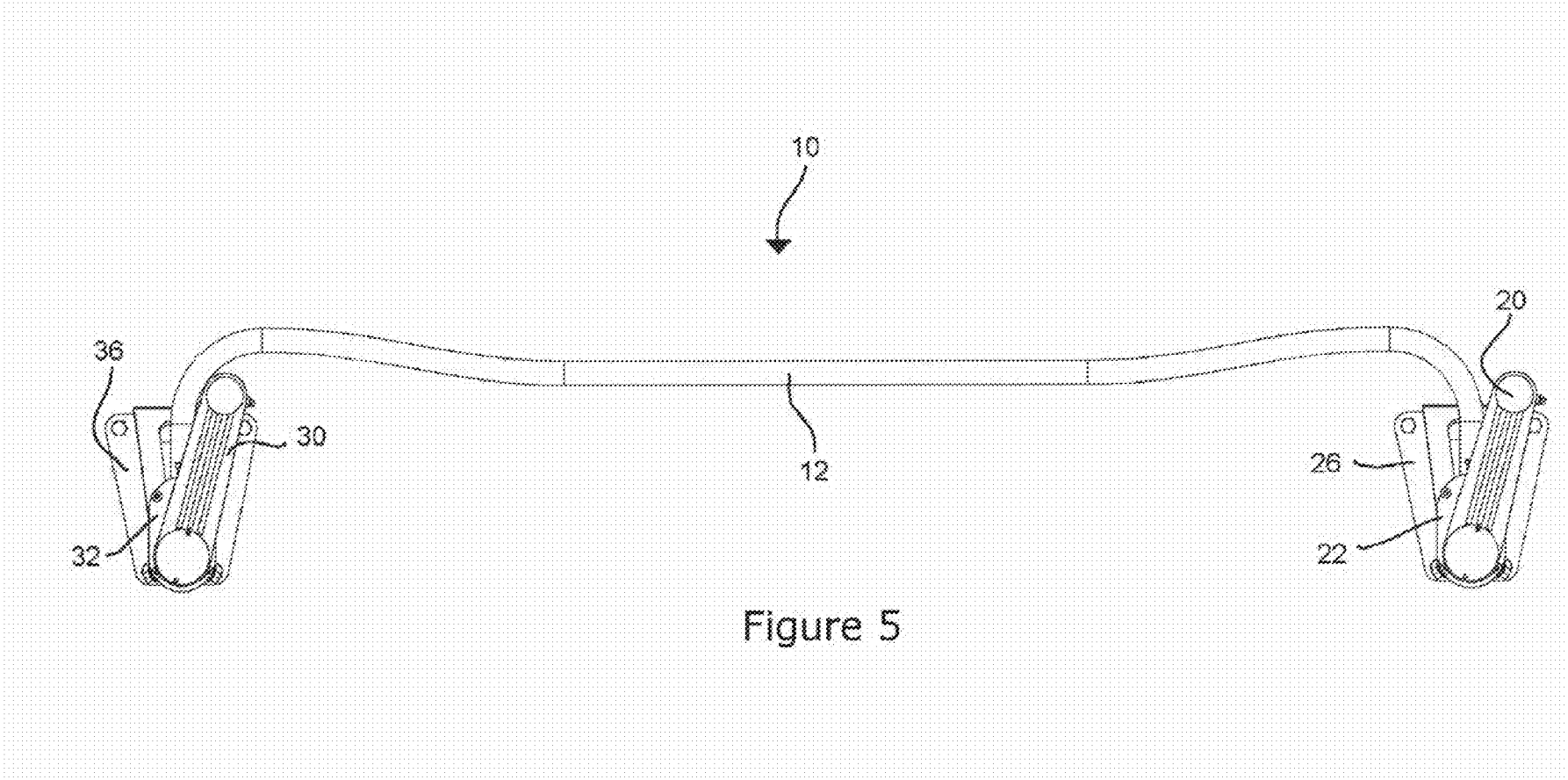
FIG. 5 is a top view of a simultaneous twin pitch adjustment system according to a first embodiment.
Figure 6:
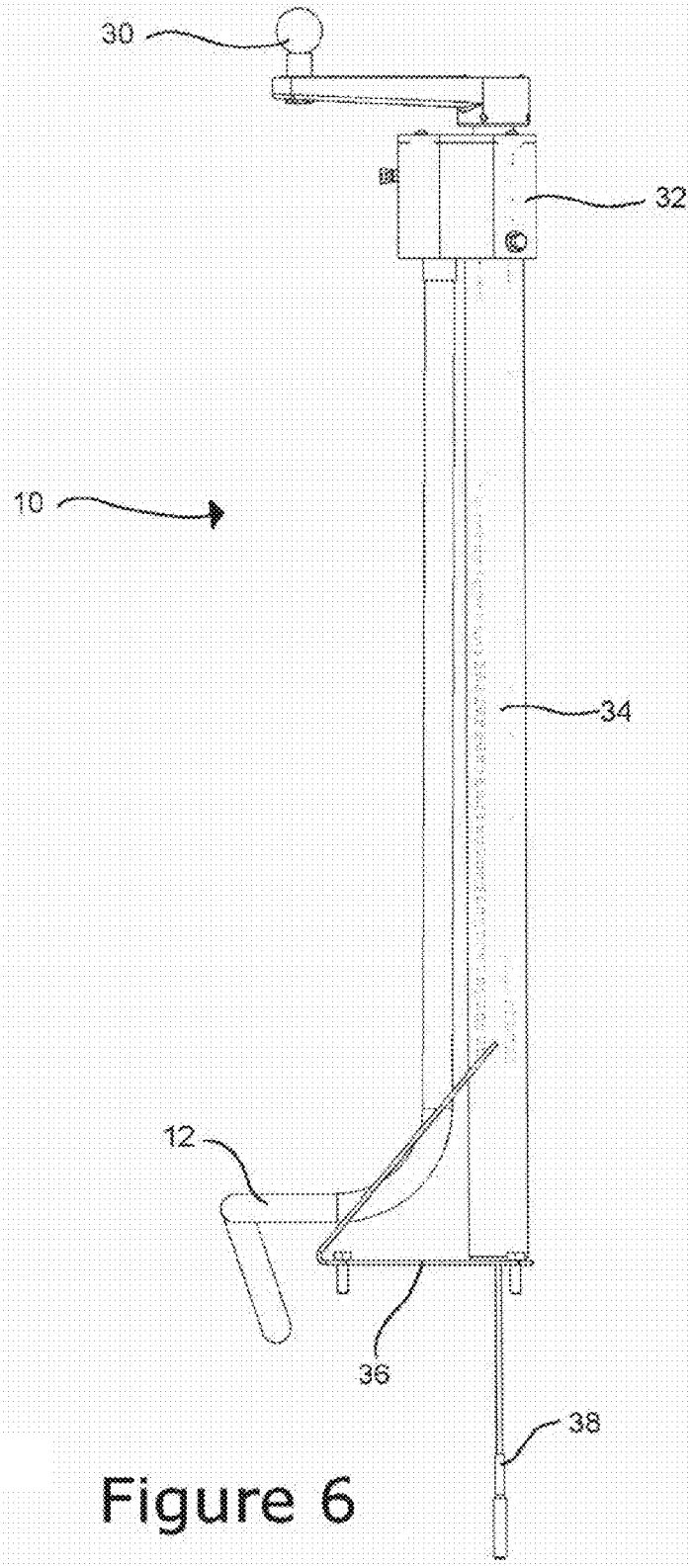
FIG. 6 is a left side elevation view of a simultaneous twin pitch adjustment system according to a first embodiment.
Figure 7:
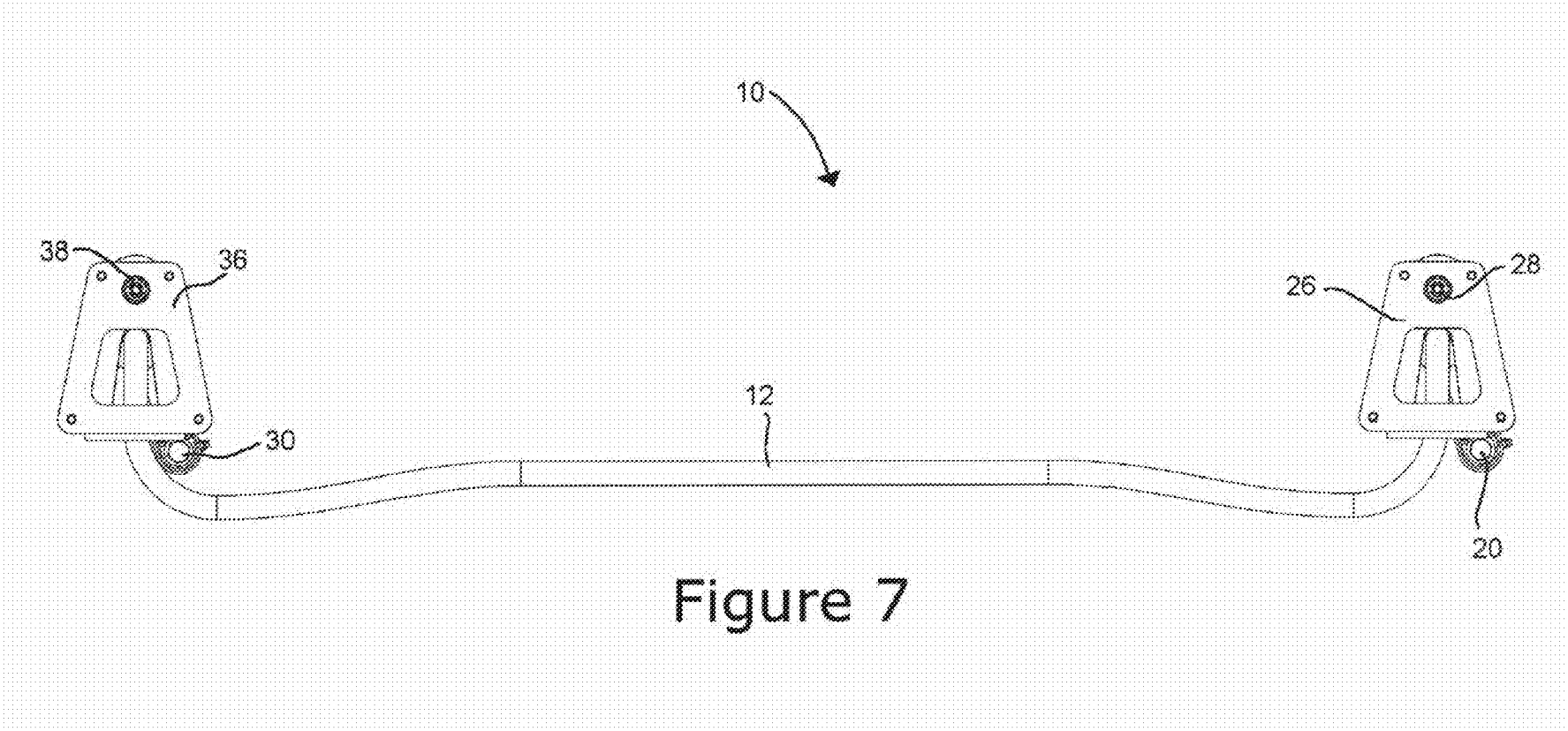
FIG. 7 is a bottom view of a simultaneous twin pitch adjustment system according to a first embodiment.

FIG. 2 shows the simultaneous twin pitch adjustment system 10 according to the first embodiment from the front. FIG. 3 shows the system 10 from the right side. FIG. 4 shows the system 10 from the back. FIG. 5 shows the system 10 from the top. FIG. 6 shows the system 10 from the left, and FIG. 7 shows the system 10 from below.

Figure 8:
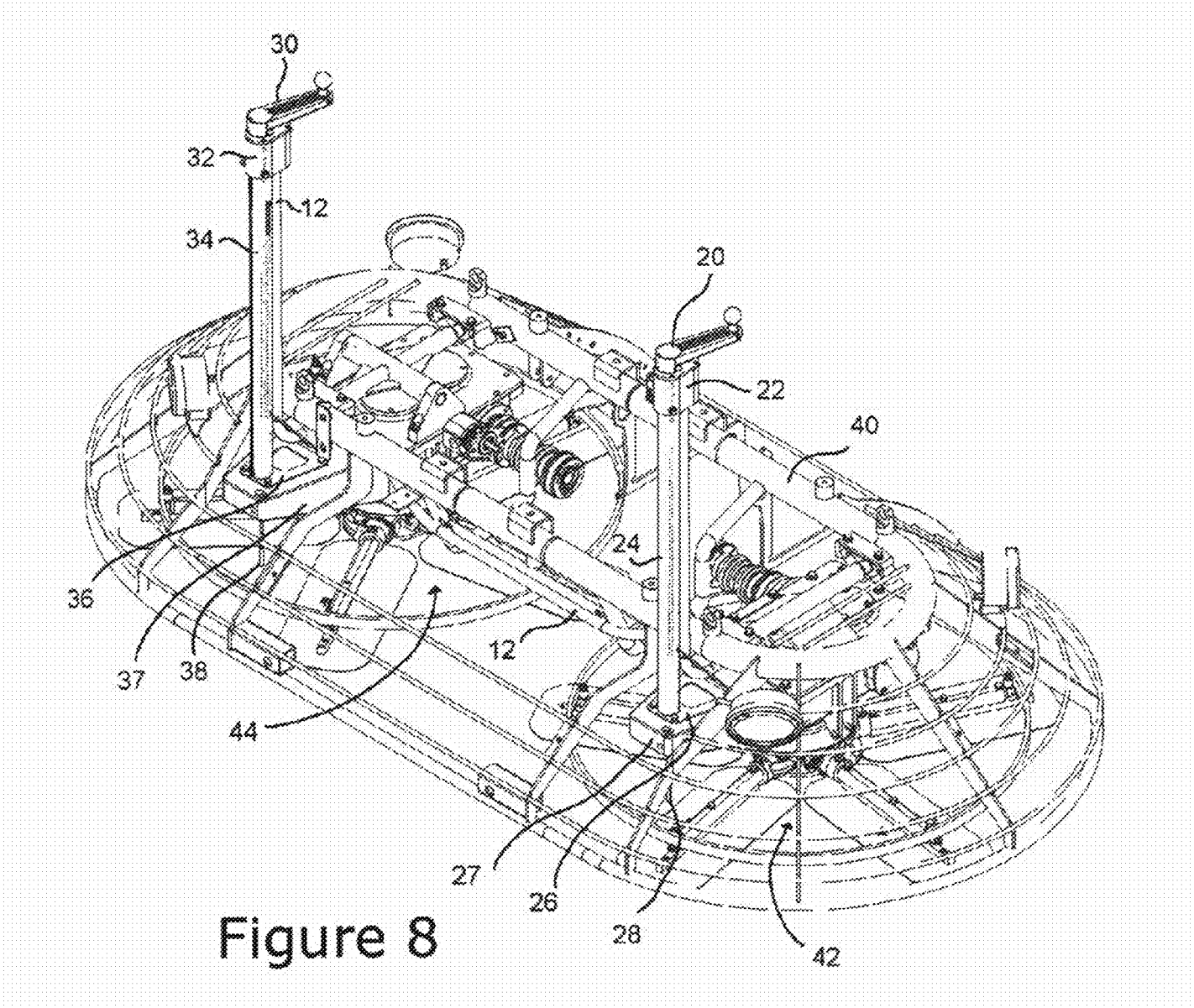
FIG. 8 is an isometric view of the simultaneous twin pitch adjustment system according to a first embodiment, in place on the frame member with rotor blade assemblies of a ride-on power trowel.
Figure 9:
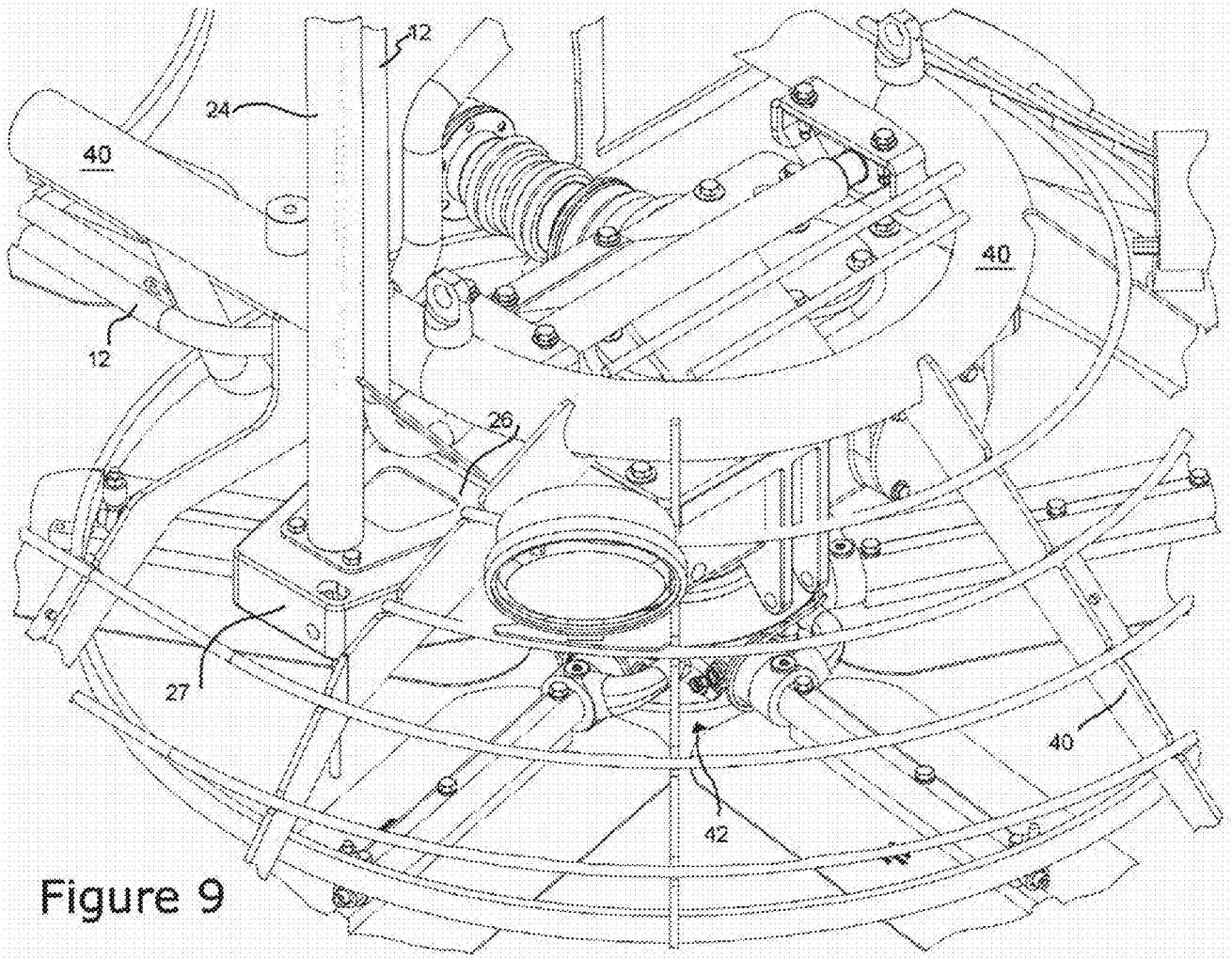
FIG. 9 is a partial, close-up view of that shown in FIG. 8.

As shown in FIG. 8, the simultaneous twin pitch adjustment system 10 is configured to be mounted to the frame 40 of a ride-on power trowel 4, or other ride-on machine. In the depicted configuration, the ride-on power trowel 4 includes a first rotor blade assembly 42 and a second rotor blade assembly 44. The first rotor blade assembly 42 is supported by the frame 40 and is operatively attached to a first rotor assembly connector 27. Preferably, the first rotor assembly connector 27 also supports the first mounting bracket 26. Accordingly, the frame 40 supports the first post 24 of the simultaneous twin pitch adjustment system 10 via the first rotor assembly connector 27. Preferably the first pitch communicator 28 is configured to be operatively connected to the first rotor blade assembly 42 through the first rotor assembly connector 27. This is further shown, in close-up, in FIG. 9.

Likewise, the second rotor blade assembly 44 is supported by the frame 40 and is operatively attached to a second rotor assembly connector 37. Preferably, the second rotor assembly connector 37 also supports the second mounting bracket 36. Accordingly, the frame 40 supports the second post 34 of the simultaneous twin pitch adjustment system 10 via the second rotor assembly connector 37. Preferably, the second pitch communicator 38 is configured to be operatively connected to the second rotor blade assembly 44 through the second rotor assembly connector 37.

Figure 10:
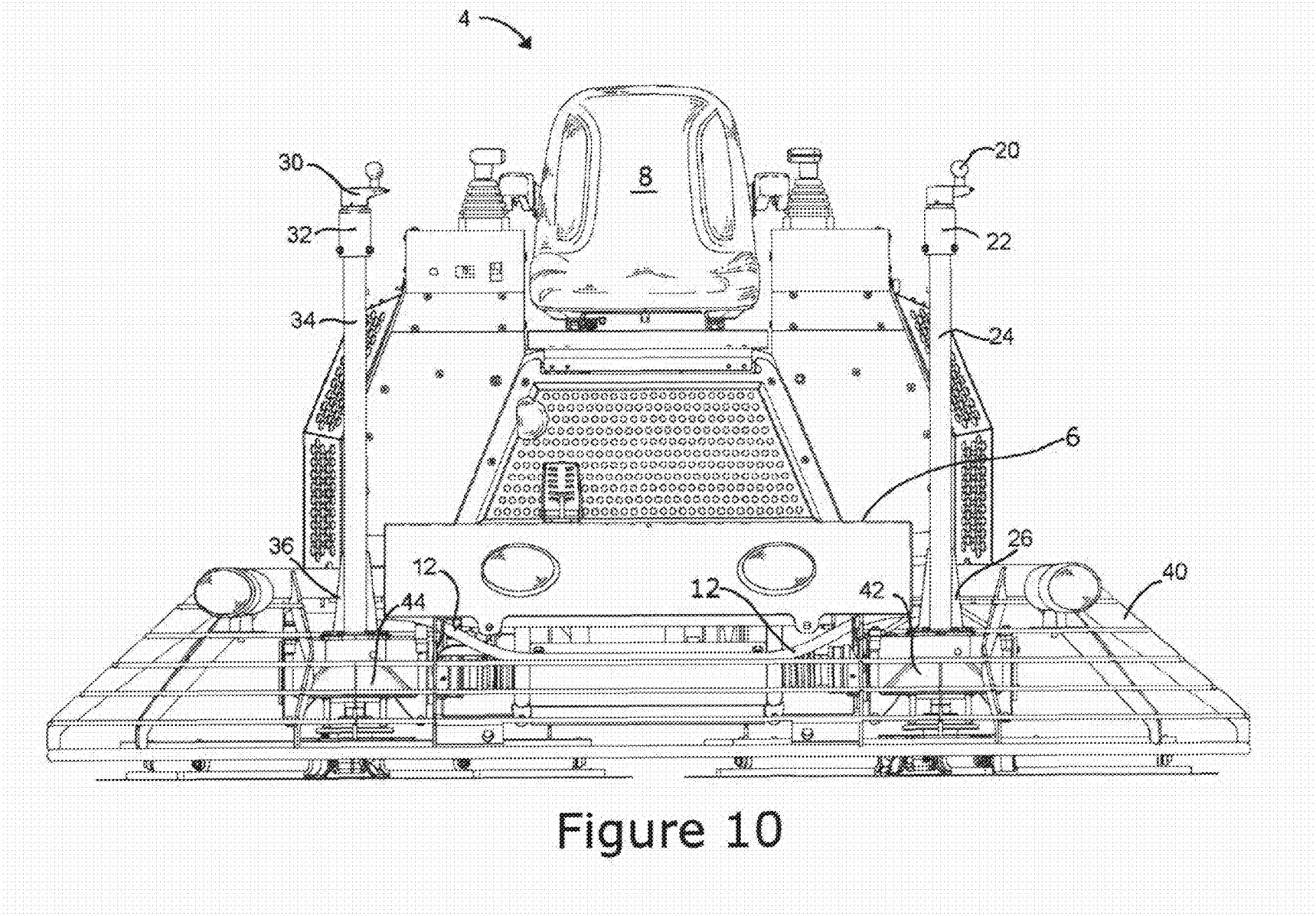
FIG. 10 is a front elevation view of the simultaneous twin pitch adjustment system according to a first embodiment, in place on a ride-on power trowel.
Figure 11:
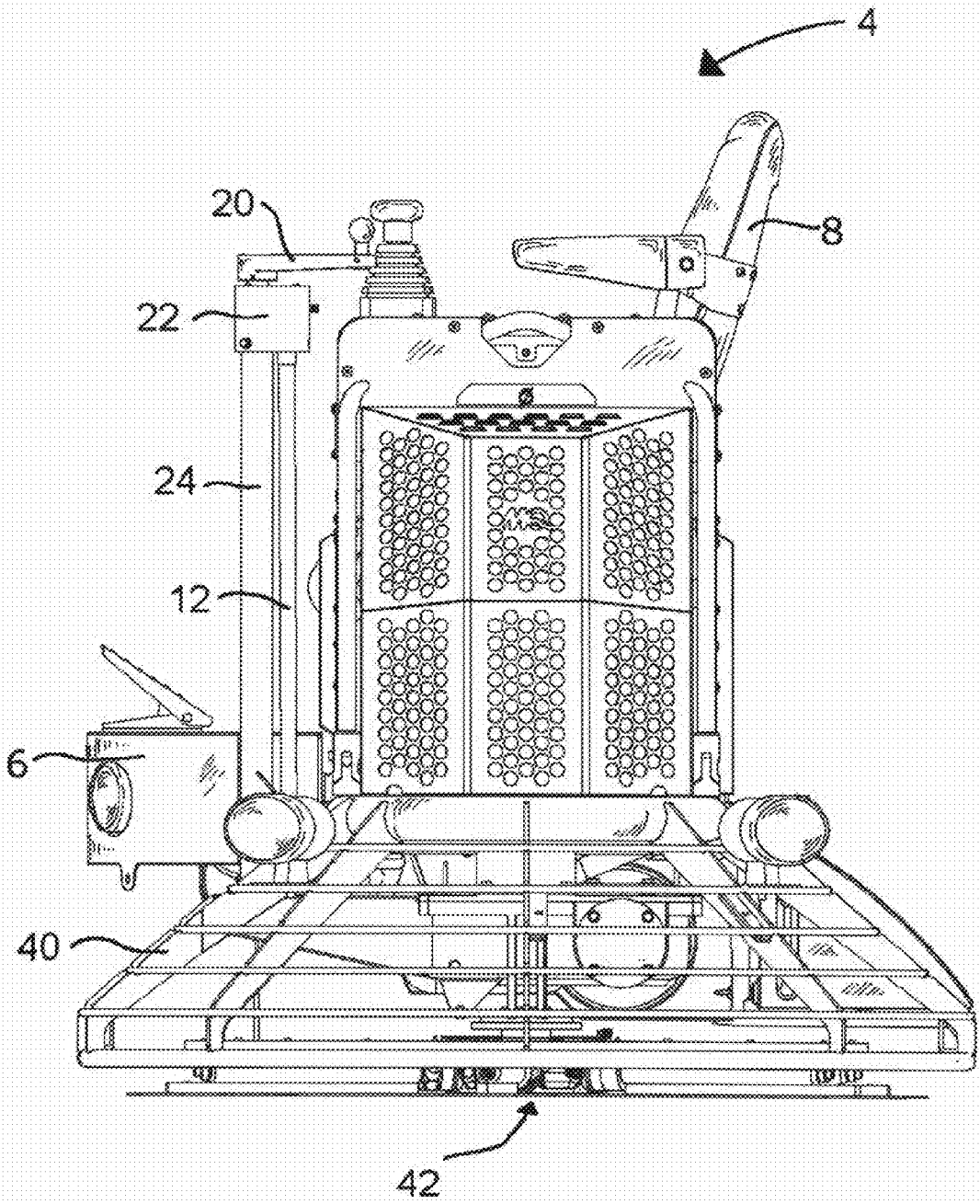
FIG. 11 is a right side elevation view of the simultaneous twin pitch adjustment system according to a first embodiment, in place on a ride-on power trowel.
Figure 12:
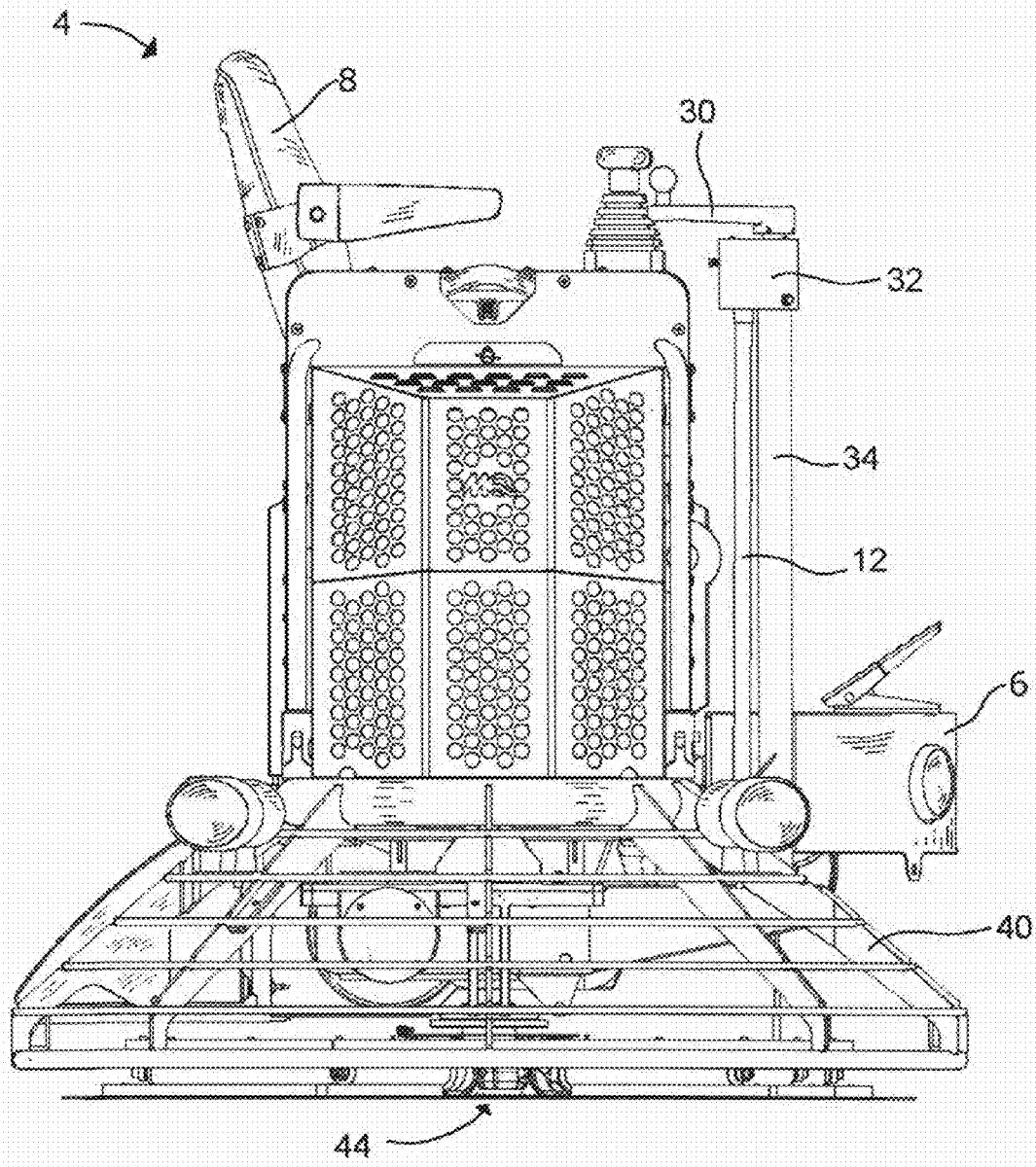
FIG. 12 is a left side elevation view of the simultaneous twin pitch adjustment system according to a first embodiment, in place on a ride-on power trowel.
Figure 13:
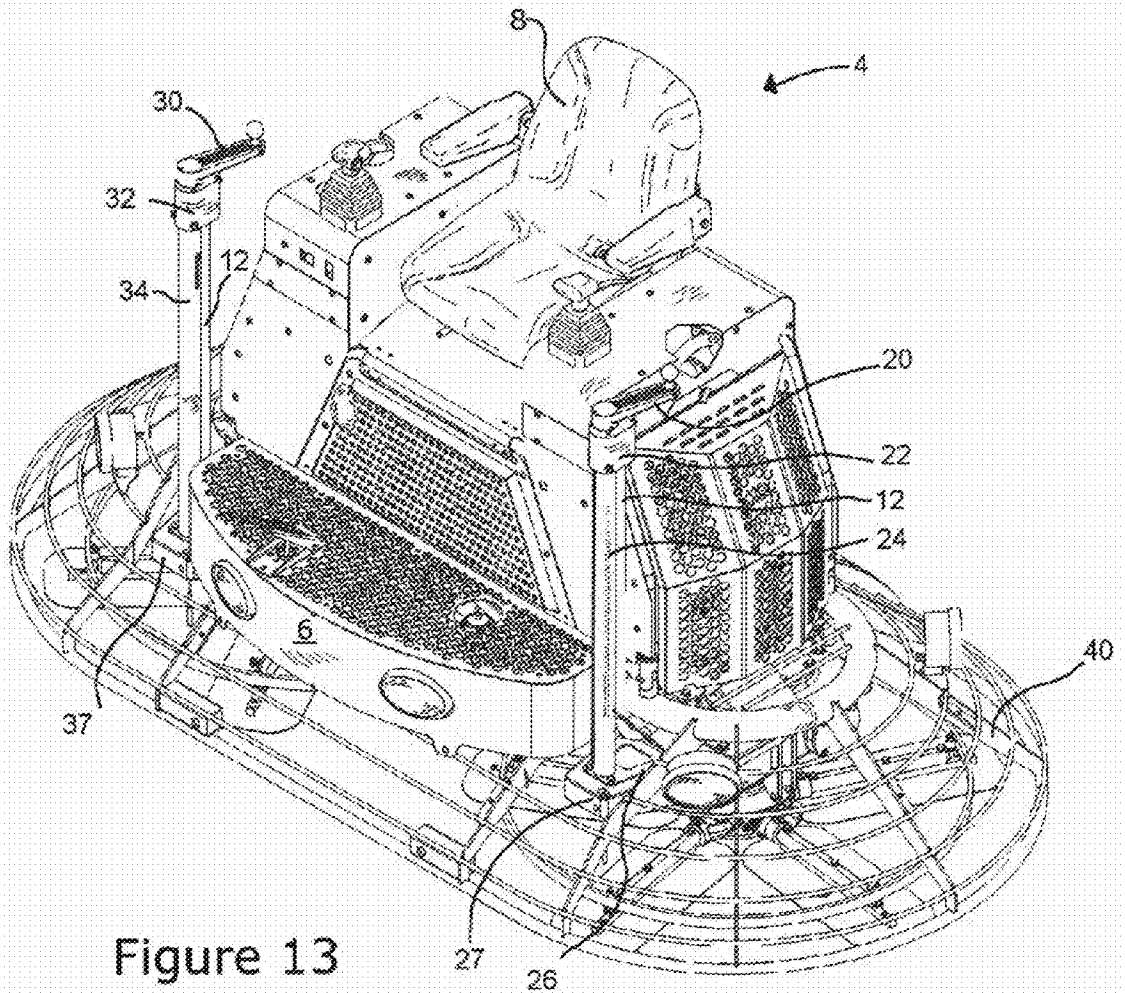
FIG. 13 is an isometric view of the front, top, and right side of the simultaneous twin pitch adjustment system according to a first embodiment, in place on a ride-on power trowel.

FIGS. 10 though 13 depict the simultaneous twin pitch adjustment system 10 in place on a ride-on power trowel 4. As shown, the ride-on power trowel 4 into which the simultaneous twin pitch adjustment system 10 is expected to be incorporated further includes an operators seat 8 situated between the first handle 20 and second handle 30, such that the handles 20, 30 are arranged within comfortable reach of an operator sitting within the seat 8. The trowel 4 further includes a front step 6, supported by the frame, and located beneath and in front of the seat 8. The front step 6 is configured to allow the operator to step up and into the seat 8 and further configured to support the operator's feet during use of the trowel 4. In other embodiments, the ride-on power trowel 4 includes different features.

As shown in FIGS. 9 through 13, the flexible shafting cord 12 that connects the operation of the first handle 20 and the second handle 30 is arranged so as to extend from the first handle 20, down the back of the first post 24, beneath the frame 40, and then pass under the rear area of the front step 6 before passing above the frame 40 and up the back of the second post 34 to attach to the second handle 30. In some embodiments, the flexible shafting cord 12 is bound to each of the first post 24 and second post 34 as with brackets connecting the flexible shafting cord 12 to the posts 24, 34. Preferably, the flexible shafting cord 12 does not contact the top of the front step 6 and does not extend into the space above the front step 6. Accordingly, the flexible shafting cord 12 does not impede the area in which an operator would approach or exit from the operator's seat 8; therefore, the flexible shafting cord 12 does not present a tripping hazard to the operator.

While there is shown and described the present preferred embodiment of the system, it is to be distinctly understood that this system is not limited thereto but may be variously embodied to practice within the scope of this disclosure. From the foregoing description, it will be apparent that various changes may be made without departing from the spirit and scope of the invention as defined by this disclosure.

Still other features and advantages of the present system will become readily apparent to those skilled in this art from the following detailed description describing preferred embodiment of the simultaneous twin pitch adjustment system, simply by way of illustration of the best mode contemplated by carrying out the system. As will be realized, the system is capable of modification in various obvious respects all without departing from the invention. For example, while the depicted embodiment shows a ride-on power trowel 4 that includes only two rotor blade assemblies, in some embodiments, the system 10 is utilized with more than two rotor blade assemblies. In some such embodiments, each rotor blade assembly is connected to a separate post, mounting bracket, coupler, handle, etc., with the flexible shafting cord 12 being connected between each of the couplers of the system. In any regard, the drawings and description of the preferred embodiments are to be regarded as illustrative in nature, and not as restrictive in nature.

The invention claimed is:

1. A pitch-adjustment assembly for selectively adjusting a first rotor blade's pitch, said first rotor blade being contained within a first rotor blade assembly, while selectively simultaneously adjusting a second rotor blade's pitch, said second rotor blade being contained within a second rotor blade assembly, said first rotor blade assembly having operatively connected thereto a first rotor assembly connector, said second rotor blade assembly having operatively connected thereto a second rotor assembly connector, said first rotor assembly connector and said second rotor assembly connector being supported by a frame, said pitch-adjustment assembly comprising:

a first mounting bracket supported by said first rotor assembly connector;

a first post connected to said first mounting bracket;

a first pitch communicator extending at least partially through said first post, said first pitch communicator being operatively connected to said first rotor blade;

a first coupler supported by said first post and operatively connected to said first pitch communicator;

a first handle supported by said first coupler, said first handle being configured to be manipulated by an operator and further configured such that manipulation of said first handle translates to manipulation of said first pitch communicator and adjustment of said first rotor blade's pitch in a first particular pitch amount;

a second mounting bracket supported by said second rotor assembly connector;

a second post connected to said second mounting bracket;

a second pitch communicator extending at least partially through said second post, said second pitch communicator being operatively connected to said second rotor blade;

a second coupler supported by said second post and operatively connected to said second pitch communicator;

a second handle supported by said second coupler, said second handle being configured to be manipulated by an operator and further configured such that manipulation of said second handle translates to manipulation of said second pitch communicator and adjustment of said second rotor blade's pitch in a second particular pitch amount;

a flexible shafting cord having a first cord end and a second cord end, said first cord end being operatively connected to said first coupler, said second cord end being operatively connected to said second coupler;

said pitch-adjustment assembly being further configured such that manipulation of said first handle selectively translates via said flexible shafting cord to manipulation of said second handle and adjustment of said second rotor blade's pitch such that said second particular pitch amount is essentially equal to said first particular pitch amount;

wherein operation of said first handle selectively leads to equal pitch adjustment of both second first rotor blade and said second rotor blade.

2. The pitch-adjustment assembly of claim 1, wherein said flexible shafting cord is arranged so as to pass along a rear area of said first post, beneath said frame, and along a rear area of said second post.

3. A pitch-adjustment assembly for selectively adjusting a first rotor blade's pitch, said first rotor blade being contained within a first rotor blade assembly, while selectively simultaneously adjusting a second rotor blade's pitch, said second rotor blade being contained within a second rotor blade assembly, said first rotor blade assembly having operatively connected thereto a first rotor assembly connector, said second rotor blade assembly having operatively connected thereto a second rotor assembly connector, said first rotor assembly connector and said second rotor assembly connector being supported by a frame, said pitch-adjustment assembly comprising:

a first mounting bracket supported by said first rotor assembly connector;

a first post connected to said first mounting bracket;

a first pitch communicator extending at least partially through said first post, said first pitch communicator being operatively connected to said first rotor blade;

a first coupler supported by said first post and operatively connected to said first pitch communicator;

a first handle supported by said first coupler, said first handle being configured to be manipulated by an operator and further configured such that manipulation of said first handle translates to manipulation of said first pitch communicator and adjustment of said first rotor blade's pitch in a first particular pitch amount;

a second mounting bracket supported by said second rotor assembly connector;

a second post connected to said second mounting bracket;

a second pitch communicator extending at least partially through said second post, said second pitch communicator being operatively connected to said second rotor blade;

a second coupler supported by said second post and operatively connected to said second pitch communicator;

a second handle supported by said second coupler, said second handle being configured to be manipulated by an operator and further configured such that manipulation of said second handle translates to manipulation of said second pitch communicator and adjustment of said second rotor blade's pitch in a second particular pitch amount;

a flexible shafting cord having a first cord end and a second cord end, said first cord end being operatively connected to said first coupler, said second cord end being operatively connected to said second coupler;

said pitch-adjustment assembly being further configured such that manipulation of said second handle selectively translates via said flexible shafting cord to manipulation of said first handle and adjustment of said first rotor blade's pitch such that said first particular pitch amount is essentially equal to said second particular pitch amount;

wherein operation of said second handle selectively leads to equal pitch adjustment of both said first rotor blade and said second rotor blade.

4. The pitch-adjustment assembly of claim 3, wherein said flexible shafting cord is arranged so as to pass along a rear area of said first post, beneath said frame, and along a rear area of said second post.

5. A pitch-adjustment assembly for selectively adjusting a first rotor blade's pitch, said first rotor blade being contained within a first rotor blade assembly, while selectively simultaneously adjusting a second rotor blade's pitch, said second rotor blade being contained within a second rotor blade assembly, said first rotor blade assembly having operatively connected thereto a first rotor assembly connector, said second rotor blade assembly having operatively connected thereto a second rotor assembly connector, said first rotor assembly connector and said second rotor assembly connector being supported by a frame, said pitch-adjustment assembly comprising:

a first mounting bracket supported by said first rotor assembly connector;

a first post mounted to said first rotor assembly connector via said first mounting bracket;

a first coupler supported by said first post, said first coupler including a first housing;

a first master gear contained within said first housing; and a first slave gear contained within said first housing and being configured to be in operative connection with said first master gear;

a first pitch communicator operationally connected to said first master gear within said first coupler such that manipulation of said first master gear translates to manipulation of said first pitch communicator, said first pitch communicator also being operationally connected to said first rotor blade within said first rotor blade assembly such that manipulation of said first pitch communicator translates to adjustment of said first rotor blade's pitch, said first pitch communicator extending from said first coupler to said first rotor assembly connector;

a first handle supported by said first coupler, said first handle being further operatively connected with said first master gear and configured such that manipulation of said first handle is translated to manipulation of said first master gear, said first handle being configured to be selectively positioned into a first engaged position wherein said first master gear is in operative connection with said first slave gear, said first handle being further configured to be selectively positioned into a first disengaged position wherein said first master gear is not in operative connection with said first slave gear;

a second mounting bracket supported by said second rotor assembly connector;

a second post mounted to said second rotor assembly connector via said second mounting bracket;

a second coupler supported by said second post, said second coupler including a second housing;

a second master gear contained within said second housing; and a second slave gear contained within said second housing and being configured to be in operative connection with said second master gear;

a second pitch communicator operationally connected to said second master gear within said second coupler such that manipulation of said second master gear translates to manipulation of said second pitch communicator, said second pitch communicator also being operationally connected to said second rotor blade within said second rotor blade assembly such that manipulation of said second pitch communicator translates to adjustment of said second rotor blade's pitch, said second pitch communicator extending from said second coupler to said second rotor assembly connector;

a second handle supported by said second coupler, said second handle being further operatively connected with said second master gear and configured such that manipulation of said second handle is translated to manipulation of said second master gear, said second handle being configured to be selectively positioned into a second engaged position wherein said second master gear is in operative connection with said second slave gear, said second handle being further configured to be selectively positioned into a second disengaged position wherein said second master gear is not in operative connection with said second slave gear;

a flexible shafting cord having a first cord end and a second cord end, said first cord end being operatively connected to said first slave gear and said second cord end being operatively connected to said second slave gear such that manipulation of said first slave gear translates to manipulation of said second slave gear via said flexible shafting cord and such that manipulation of said second slave gear translates to manipulation of said first slave gear via said flexible shafting cord;

whereby, with said first handle being positioned in said first engaged position and said second handle being positioned in said second engaged position, manipulation of said first handle a first engaged adjustment amount translates to adjustment of said first rotor blade's pitch a first particular pitch amount and further translates to adjustment of said second rotor blade's pitch a second particular pitch amount that is essentially equal to said first particular pitch amount;

whereby, with said first handle being positioned in said first engaged position and said second handle being positioned in said second engaged position, manipulation of said second handle a second engaged adjustment amount translates to adjustment of said second rotor blade's pitch a third particular pitch amount and further translates to adjustment of said first rotor blade's pitch a fourth particular amount that is essentially equal to said third particular pitch amount;

whereby, with said first handle being positioned in said first disengaged position, manipulation of said first handle a first disengaged adjustment amount translates via said first master gear to adjustment of said first rotor blade's pitch a fifth particular pitch amount but does not translate to adjustment of said second rotor blade's pitch;

whereby, with said second handle being positioned in said second disengaged position, manipulation of said second handle a second disengaged adjustment amount translates via said second master gear to adjustment of said second rotor blade's pitch a sixth particular pitch amount but does not translate to adjustment of said first rotor blade's pitch;

whereby, with said first handle being positioned in said first disengaged position, manipulation of said second handle a third disengaged adjustment amount translates via said first master gear to adjustment of said first rotor blade's pitch a seventh particular pitch amount but does not translate to adjustment of said second rotor blade's pitch; and whereby, with said second handle being positioned in said second disengaged position, manipulation of said first handle a fourth disengaged adjustment amount translates via said second master gear to adjustment of said second rotor blade's pitch an eight particular pitch amount but does not translate to adjustment of said first rotor blade's pitch.

6. The pitch-adjustment assembly of claim 5, wherein said first pitch communicator extends from said first coupler to said first rotor assembly connector by passing through said first post.

7. The pitch-adjustment assembly of claim 5, wherein said second pitch communicator extends from said second coupler to said second rotor assembly connector by passing through said second post.

8. The pitch-adjustment assembly of claim 5, wherein said flexible shafting cord is arranged so as to pass along a rear area of said first post, beneath said frame, and along a rear area of said second post.

9. The pitch-adjustment assembly of claim 5, wherein said pitch-adjustment assembly does not include a miter box.

10. The pitch-adjustment assembly of claim 5, wherein said frame further supports a front step and an operator's seat, said flexible shafting cord being further arranged so as to not come into contact with or pass over or in front of said front step.

11. The pitch-adjustment assembly of claim 5, wherein said first handle is further configured to be selectively transitioned between said first engaged position and said first disengaged position by lifting said first handle away from said first coupler.

12. The pitch-adjustment assembly of claim 5, wherein said first handle is further configured to be selectively transitioned between said first disengaged position and said first engaged position by lowering said first handle into closer proximity to said first coupler.

13. The pitch-adjustment assembly of claim 5, wherein said second handle is further configured to be selectively transitioned between said second engaged position and said second disengaged position by lifting said second handle away from said second coupler.

14. The pitch-adjustment assembly of claim 13, wherein said second handle is further configured to be selectively transitioned between said second disengaged position and said second engaged position by lowering said second handle into closer proximity to said second coupler.

* * * * *